US008474812B1

(12) United States Patent
Blair et al.

(10) Patent No.: US 8,474,812 B1
(45) Date of Patent: Jul. 2, 2013

(54) MANUALLY TRANSLATABLE PICK MECHANISM FOR FEEDING SHEETS OF MEDIA OF DIFFERENT WIDTHS

(75) Inventors: Brian Allen Blair, Richmond, KY (US); Niko Jay Murrell, Lexington, KY (US); Jason Lee Rowe, Richmond, KY (US); Jeffrey Lawrence Tonges, Versailles, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/455,940

(22) Filed: Apr. 25, 2012

(51) Int. Cl.
*B65H 3/06* (2006.01)

(52) U.S. Cl.
USPC ..... 271/109; 271/117; 271/171

(58) Field of Classification Search
USPC ..... 271/109, 117, 18, 118, 273, 274, 271/171
See application file for complete search history.

(56) References Cited

U.S. PATENT DOCUMENTS

| | | | | |
|---|---|---|---|---|
| 4,098,501 | A * | 7/1978 | Tani et al. | 271/117 |
| 5,060,926 | A * | 10/1991 | Murai et al. | 271/111 |
| 5,294,104 | A | 3/1994 | Nishigaki | |
| 5,975,517 | A | 11/1999 | Lim | |
| 7,717,417 | B2 * | 5/2010 | Murrell | 271/121 |
| 7,918,445 | B2 * | 4/2011 | Okamoto | 271/117 |
| 8,246,043 | B2 * | 8/2012 | Wu | 271/118 |
| 8,322,704 | B1 * | 12/2012 | Blair et al. | 271/117 |
| 2007/0052153 | A1 | 3/2007 | DeVore et al. | |
| 2007/0158901 | A1 * | 7/2007 | Lee | 271/171 |
| 2010/0096800 | A1 * | 4/2010 | Funada | 271/114 |
| 2010/0194022 | A1 | 8/2010 | Kawaguchi | |
| 2011/0049785 | A1 * | 3/2011 | Wang | 271/110 |
| 2011/0298174 | A1 | 12/2011 | Wang | |

FOREIGN PATENT DOCUMENTS

JP 56033329 A * 4/1981

OTHER PUBLICATIONS

Non-Final Office Action for related U.S. Appl. No. 13/198,946, dated Jun. 13, 2012.

* cited by examiner

*Primary Examiner* — Jeremy R Severson
(74) *Attorney, Agent, or Firm* — John Victor Pezdek

(57) ABSTRACT

A system for manual adjustment of a pick mechanism between multiple positions transverse to a media feed direction associated with different widths of media such that pick forces are substantially balanced about the centerline of a media sheet to be picked. The system includes a shaft for receiving torque, a pick mechanism having a pick arm, and a pick arm adjustment mechanism coupled to the pick mechanism during translating of the pick arm. The pick arm is rotatably and slidably mounted at a first end thereof on the shaft. The pick arm adjustment mechanism comprises a translating member rotatably and slidably mounted on the shaft and coupled to a portion of the first end of the pick arm allowing the pick mechanism to be lifted from a topmost media sheet and allow manual translation of the translating member and pick arm to one of the plurality of predetermined positions.

30 Claims, 10 Drawing Sheets

MANUALLY TRANSLATABLE PICK MECHANISM FOR FEEDING SHEETS OF MEDIA OF DIFFERENT WIDTHS

CROSS REFERENCES TO RELATED APPLICATIONS

This patent application is related to the U.S. patent application Ser. No. 13/198,946, filed Aug. 5, 2011, entitled "System and Device for Feeding Sheets of Media" and assigned to the assignee of the present application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to a device and a system for feeding a media sheet from a stack of media sheets and, more particularly, to a device and a system for manually adjusting the position of a pick arm relative to a media sheet across a media feed direction.

2. Description of the Related Art

A typical image forming apparatus such as an electrophotographic printer or an inkjet printer, for example, includes a media sheet feed system having a media picking mechanism for picking a media sheet and a media tray for holding a stack of media sheets, such as paper, on which to print images. One type of picking mechanism utilizes an auto compensating pick module (ACM). The ACM includes at least one pick roller and a gear train that transmits both a rotational force and a downward force to the pick roller.

In reference edge type systems, the ACM is typically positioned to feed a wide range of media sizes without requiring adjustments. For example, the ACM may be positioned across the media feed direction such that there are two pick rollers touching any supported media from the narrowest to the widest. If two rollers are not placed on a supported media, misfeeds and paper jams may result during a sheet pick operation.

However, when the ACM is positioned to allow feeding of a narrowest supported media, pick reliability of a widest supported media may be compromised. This is because the ACM is positioned offset from the centerline of the widest supported media in order to support the narrowest supported media. When pick forces are applied to a wide media sheet, the offset location of the pick forces creates a moment on the media sheet that skews the media when picked. The skew in the media must then be removed by a downstream media alignment system before image transfer. Skewing the media during a pick operation further creates an opportunity for paper jams and increases the amount of energy that must be used on the media sheet by the alignment system.

Based upon the foregoing, there is a need to effectively reduce pick skew and improve reliability of a picking mechanism in reference edge type systems by substantially eliminating the moment placed on the sheet by the pick rollers during a media sheet picking operation. Further, there is also a need to increase the number of different media sizes supported by a media tray in an image forming apparatus without compromising pick reliability of the widest supported media.

SUMMARY

Embodiments of the present disclosure provide for reduced pick skew and improved reliability of a picking mechanism by allowing a pick arm to be manually adjusted between multiple locations across the media feed direction depending on media size such that media pick forces are substantially balanced about the centerline of a media sheet being picked.

In an example embodiment, the present disclosure relates to a media picking device comprising a shaft for receiving torque from the imaging apparatus and a pick arm pivotally and slidably mounted at a first end thereof on the shaft. At least one pick roller is mounted at a second end of the pick arm and contacts a topmost media sheet of a stack of media sheets and is driven by the shaft to pick the topmost media sheet therefrom when the pick arm is in a first position. A translating member is coupled with a portion of the first end of the pick arm and slidably and rotatably movable with the pick arm. The translating member is rotatable about the shaft between the first position and a second position where the at least one pick roller is moved from contacting the topmost media sheet. The translating member, when rotated to the second position, is translatable with the pick arm along the shaft between a plurality of predetermined positions corresponding to a plurality of centerlines of media sheets of different widths. When located at a selected one of the plurality of predetermined positions and rotated to the first position, the translating member and pick arm are held in position such that the at least one pick roller is substantially evenly positioned about a corresponding centerline of a media sheet corresponding to the selected one of the plurality of positions.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
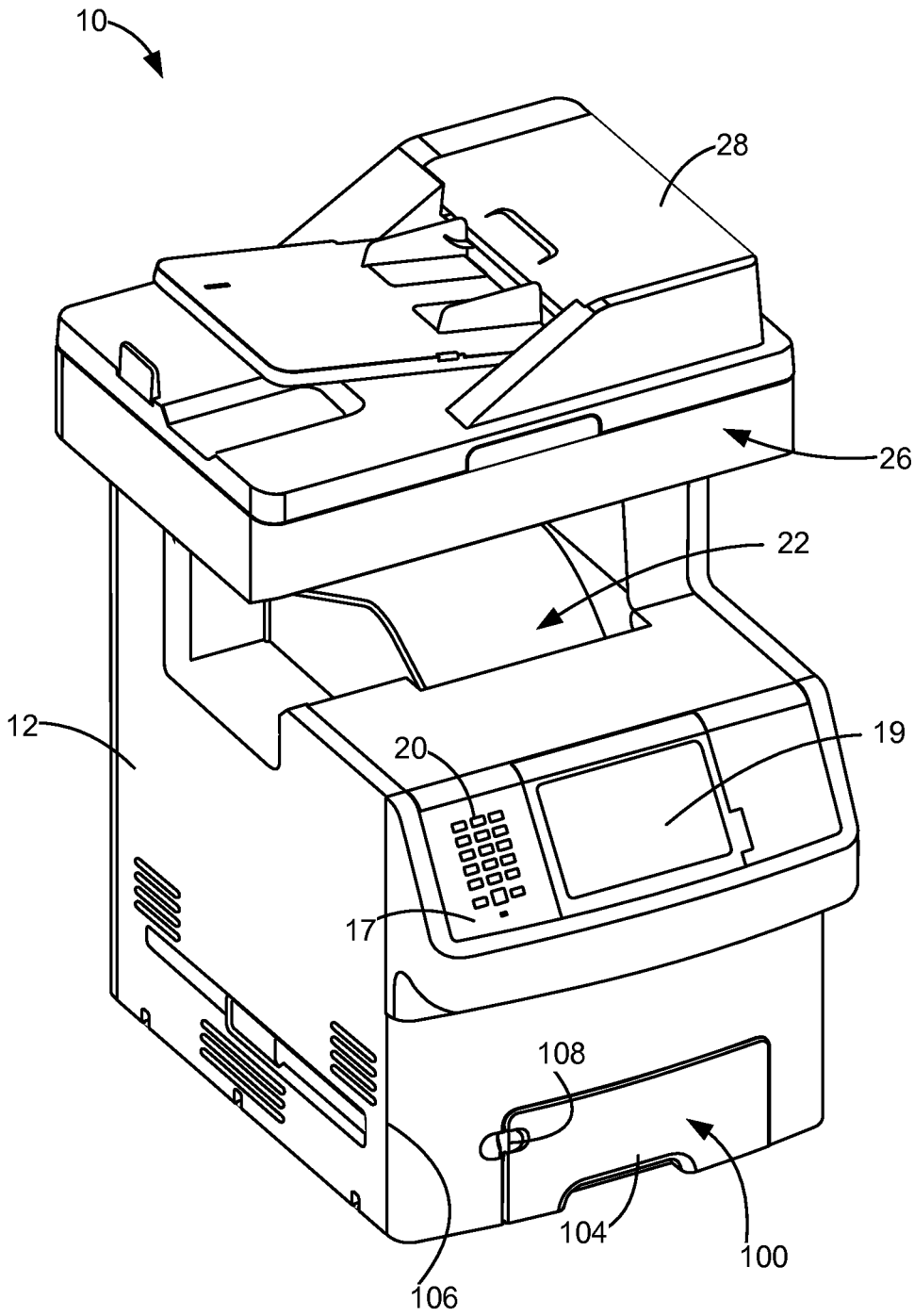
FIG. 1 is a perspective view of one example embodiment of an imaging apparatus.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

In addition, the terms "connected" and "coupled" and variations thereof are not restricted to physical or mechanical connections or couplings.

Spatially relative terms such as "top", "bottom", "front", "back", "rear" and "side", "above", "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Figure 2:
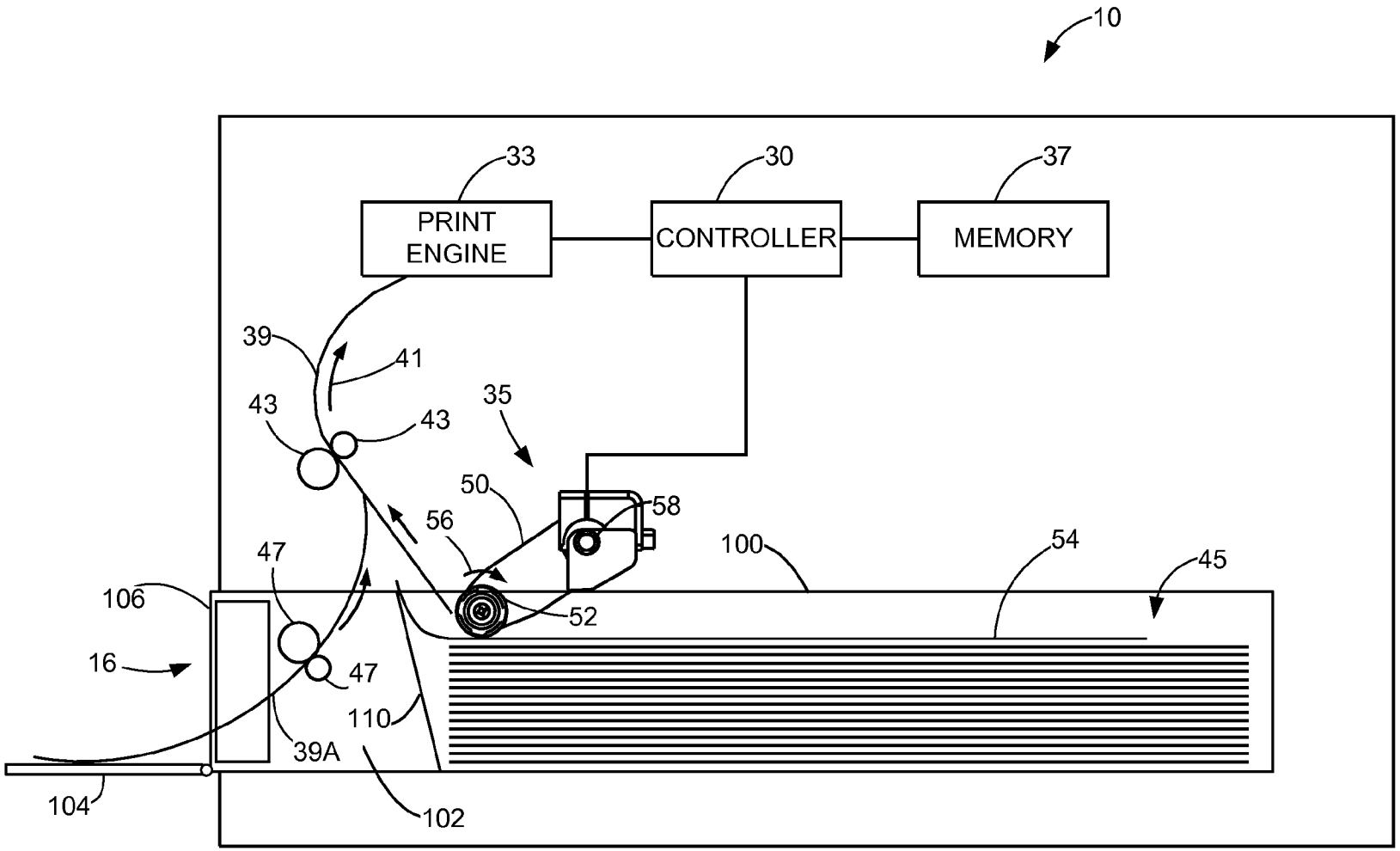
FIG. 2 is a schematic diagram depicting some components of the imaging apparatus in FIG. 1.

Referring now to the drawings and particularly to FIGS. 1 and 2, there is shown an imaging apparatus 10. Imaging apparatus 10, which may be a standalone imaging device, includes a housing 12 having an input media tray 100 for supporting sheets of media, such as, but not limited to, paper, card stock film, such as transparencies, or printer labels. Input media tray 100 may be inserted into or removed from the imaging apparatus 10. Additionally, input media tray 100 may include a multi-purpose feeder (MPF) 16 disposed within a front portion 102 of media tray behind front panel 104 mounted in a wall 106 of media tray 100. Front panel 104 may be rotatably connected to a wall 106 of media tray 100 and opened to provide access to MPF 16, as shown for example in FIG. 6. A latch 108 is provided on front panel 104 to secure it in the closed position. Front panel 104 may be comprised of two or more overlapping segments that may be slidably extended to provide a support surface or tray that supports a stack of media sheets or documents for feeding through MPF 16. A media output area 22 may be positioned along an upper part of imaging apparatus 10 in which printed media sheets are placed. Imaging apparatus may also include a scanner portion 26 including an auto-document feeder (ADF) 28. Imaging apparatus 10 may include a user interface 17, such as a graphical user interface, for receiving user input concerning operations performed or to be performed by imaging apparatus 10, and for providing to the user information concerning the same. User interface 17 may include a display panel 19, which may be a touch screen display in which user input may be provided by the user touching or otherwise making contact with graphic user icons in the display panel 19. Display panel 19 may be disposed along the upper part of imaging apparatus 10 and may be sized for providing graphic images that allow for convenient communication of information between imaging apparatus 10 and the user. In addition or in the alternative, input keys 20 may be provided to receive user input.

FIG. 2 is an illustrative embodiment depicting at least some of the components of imaging apparatus 10. Imaging apparatus 10 may include a controller 30 communicatively coupled to a print engine 33 and a sheet feed system 35. Controller 30 may include a processor unit (not shown) and an associated memory 37, and may be formed as one or more Application Specific Integrated Circuits (ASICs). Memory 37 may be any volatile or non-volatile memory of combination thereof such as, for example, random access memory (RAM), read only memory (ROM), flash memory and/or non-volatile RAM (NVRAM). Alternatively, memory 37 may be in the form of a separate electronic memory (e.g., RAM, ROM, and/or NVRAM), a hard drive, a CD or DVD drive, or any memory device convenient for use with controller 30. The user interface 17 may include firmware maintained in memory 37 within housing 12 which may be performed by controller 30 or other processing element.

Controller 30 may communicate with print engine 33. Controller 30 may serve to process print data and to operate print engine 33 during printing of an image onto a sheet of media. Print engine 33 may include any of a variety of different types of printing mechanisms including dye-sublimation, dot-matrix, ink jet or laser printing.

With continued reference to FIG. 2, imaging apparatus 10 has a media path 39 through which media sheets travel in a process direction, as indicated generally by arrow 41. A plurality of pairs of rollers, such as rollers 43, may be disposed within imaging apparatus 10 along media path 39 for guiding a picked media sheet from a stack of media sheets 45 in the media input tray 100 through media path 39, moving the picked media sheet to a location adjacent print engine 33 for printing an image thereon and then moving the picked media sheet having the printed image to media output area 22. The media path 39 may be configured as an L-shaped media path, a C-shaped media feed path, a straight-through feed path or other media feed path configuration known in the art. Further, media sheets may also be introduced into media path 39 in a variety of different manners. For example, media sheets may be manually loaded by an operator via front panel 104 into the multi-purpose feeder 16. Associated roller pair 47 located in the front portion 102 of media tray 100 receives a media sheet from MFP 16 and moves the media sheet along an auxiliary media path 39A and into media path 39. Controller 30 is used to control the operation of roller pairs 43, 47 to coordinate movement of media sheets along media path 39 and auxiliary media path 39A.

Sheet feed system 35 includes a pick arm 50 mounting a pick roller (or pick rollers) 52 which rests on topmost media sheet 54 of media stack 45 in media tray 100. Pick roller 45 rotates in a direction indicated by arrow 56 to move media sheet 54 into a media dam 110 located within wall 106 and into media path 39. In an example embodiment, pick arm 50 of the sheet feed system 35 may be an auto compensating pick module (ACM) having a drive train (not shown) encased within pick arm 50 for transmitting from a drive shaft 58 both a rotational force and a downward force to pick roller 52. Drive shaft 58 is mechanically coupled to a drive motor (not shown) under the control of controller 30. The drive train may include a plurality of gears, pulleys, belts or the like for transferring rotational power from the drive motor to pick roller 52. The drive motor may be a D.C. motor forming part of the sheet feed system 35, or may be in the form of a separate motor which is coupled to sheet feed system 35 using a transmission and clutch (not shown) or the like.

Figure 3:
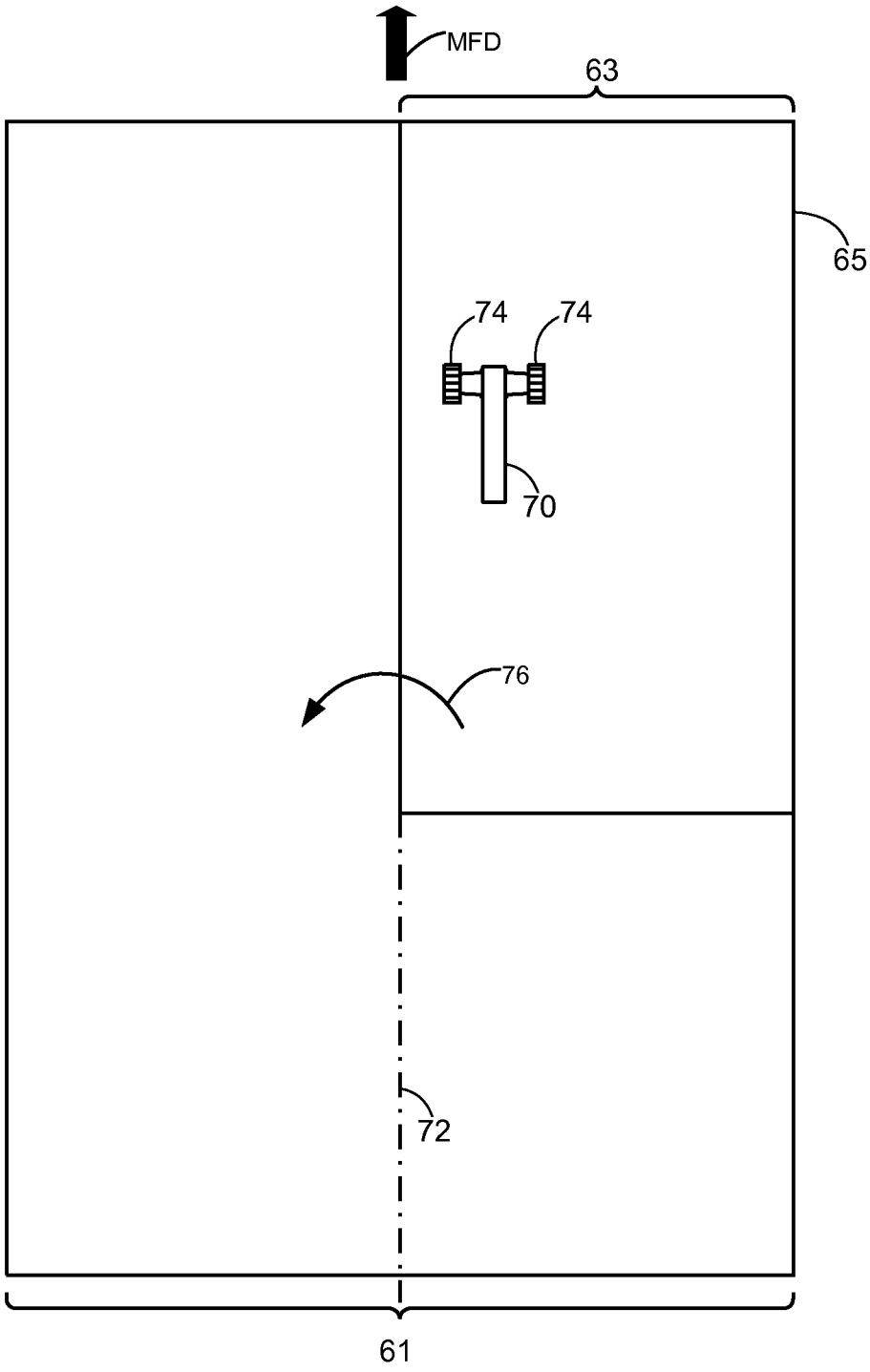
Figure 3 PRIOR ART
FIG. 3 is an illustrative view of a traditional pick arm position on a media sheet in reference edge type systems.

In prior art reference edge type systems as depicted in FIG. 3, a stack of widest supported media 61 and a stack of narrowest supported media 63 may be positioned within a media tray towards a reference edge 65 thereof. As shown, a pick arm 70 is disposed at a fixed position across the media sheet that is offset from a centerline 72 of the widest supported media 61 such that two pick rollers 74 contact a topmost sheet for both the stack of widest supported media 61 and the stack of narrowest supported media 63. While this prior art arrangement generally ensures reliable sheet picking operation for both the widest and narrowest supported media, pick reliability of the widest supported media is compromised. When pick forces are applied to the topmost sheet to move the topmost sheet in the media feed direction indicated by arrow MFD, the offset arrangement of the pick arm 70 creates a moment indicated by curved arrow 76 about the center of gravity of the top media sheet of the stack of widest supported media 61 that induces skewing of the topmost sheet upon feeding into the imaging apparatus, thereby increasing the probability of paper jams. To improve feed reliability in reference edge type systems, media pick forces should remain substantially balanced about the centerline of a media to be picked regardless of media size.

Figure 5:
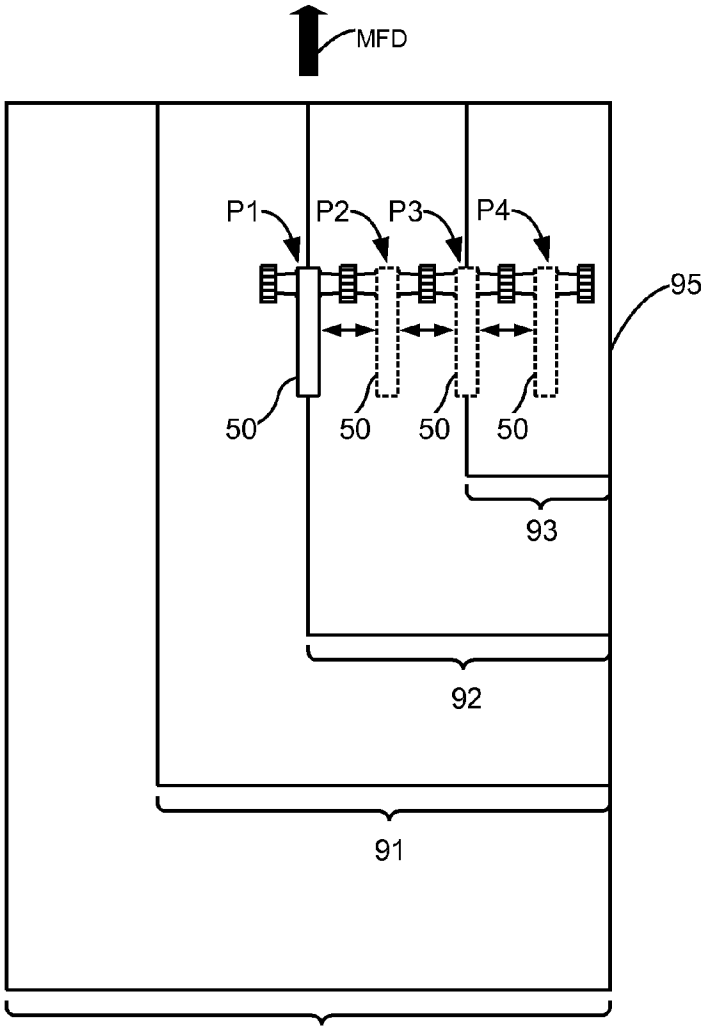
FIG. 5 is an example embodiment illustrating a pick arm that translates between multiple positions.
Figure 4:
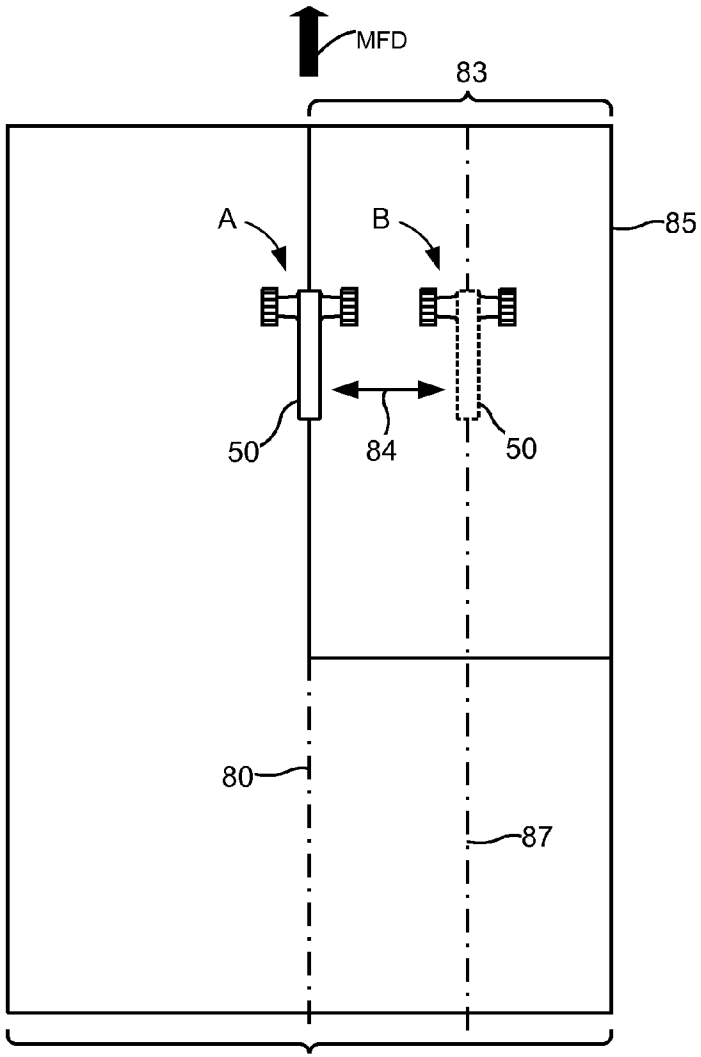
FIG. 4 is an example embodiment illustrating a pick arm that translates between two positions.

In accordance with example embodiments of the present disclosure, sheet feed system 35 may include features that enable pick arm 50 to be translatable in a direction transverse to or across the media feed direction indicated by arrow MFD to allow pick arm 50 to be suitably positioned along a centerline of a stack of media sheets so as to provide little, if any, skewing forces on the top sheet of the stack being picked. In an example embodiment, pick arm 50 may be movable between two pick positions A and B, as shown in FIG. 4. In particular, pick arm 50 may be positioned along a centerline 80 of a wide media 81 which may be, for example, A4, Letter, or Legal. If a narrow media 83, such as an A5 media, is to be picked by pick arm 50, pick arm 50 is translated in a direction 84 transverse to the media feed direction indicated by arrow MFD towards the reference edge 85 to position B along a centerline 87 of the narrow media 83. In another example embodiment, as shown in FIG. 5, pick arm 50 is illustrated as being be movable relative to reference edge 95 between a plurality of pick positions P1, P2, P3, P4, in a direction traverse to the media feed direction indicated by arrow MFD to accommodate a multiplicity of media sizes. Four media sizes, 90, 91, 92 and 93, are illustrated with media size 90 being the widest and then decreasing in width through media sizes 91, 92 and 93.

Figure 6:
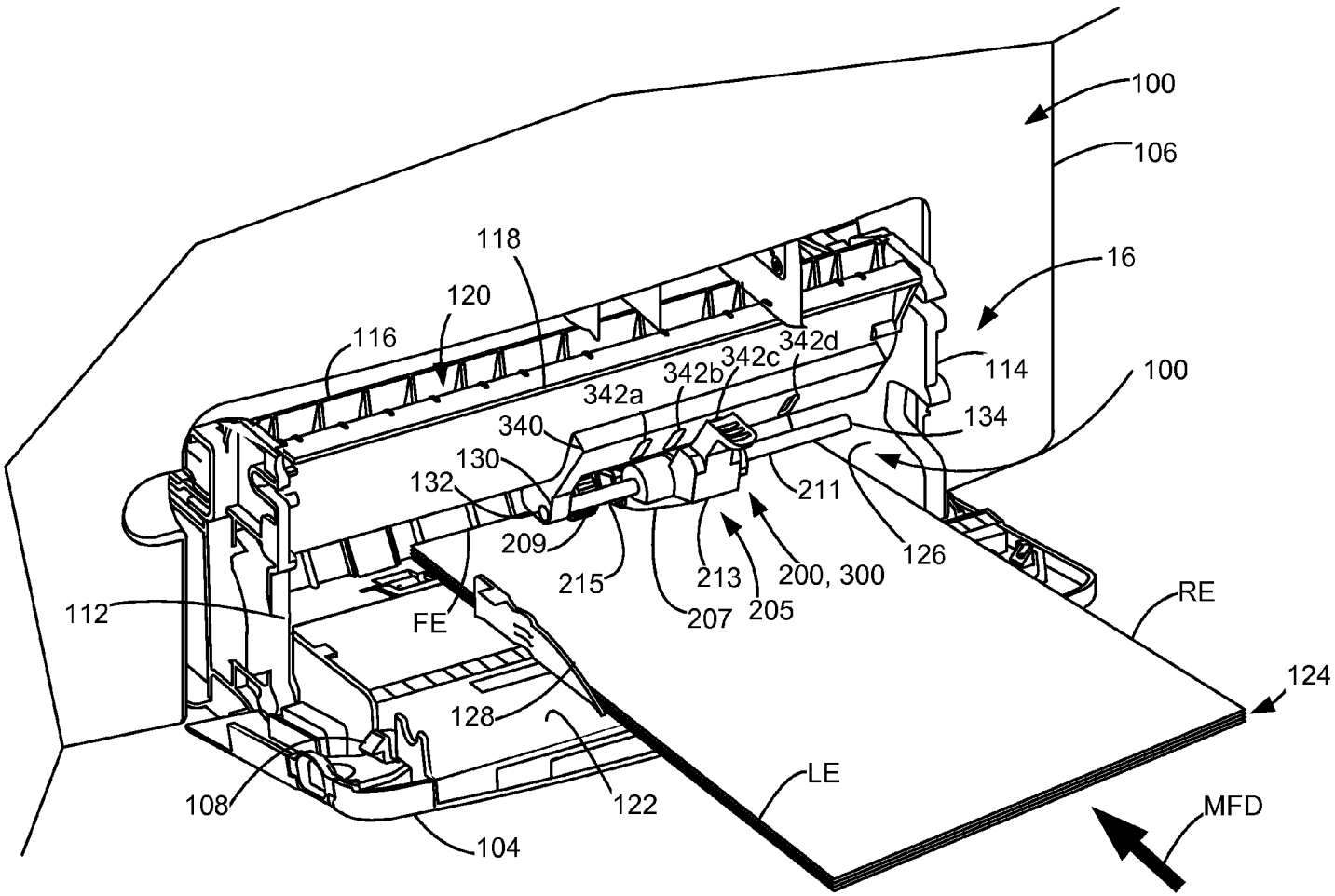
FIG. 6 is a perspective view of a sheet feed system of a multi-purpose feeder of the imaging apparatus in FIG. 1 illustrating a pick arm assembly that is manually translatable between multiple positions.

FIG. 6 illustrates a sheet feed system 200 of multi-purpose feeder 16 mounted on a wall 106 of media tray 100 according to an example embodiment. Front panel 104 of media tray 100 is shown in the open position and is pivotally attached to left and right extensions 112, 114, of wall 106. Extending between the left and right wall extensions 112, 114 is media dam 116. In front of media dam 116 as viewed in FIG. 6 is guide member 118 that extends between left and right wall extensions 112, 114. Guide member 118 is parallel to but spaced apart from media dam 116 forming a media channel 120 through which media sheets from MPF 16 are fed into auxiliary media path 39A. A media support surface 122 is provided on the inside of front panel 104 for supporting one or more sheets of media 124. Media support surface 122 may comprise two or more overlapping members that may be extended outwardly to provide a large support surface area for media sheets 124. The right edges RE of media sheets 124 abut a reference edge surface 126 on right wall extension 114 and are held in place by transversely slidable edge guide 128 that abuts the left edges LE of media sheets 124. Slidable edge guide 128 is mounted on media support surface 122. Front edges FE of media sheets 124 abut media dam 116 that is transverse to the media feed direction. Media dam 116, which is at an angle with respect to media support surface 122, directs the front edge FE of the picked media sheet into auxiliary media path 39A. Guide member 120 is also spaced above media support surface 122. Sheet feed system 200 is mounted within this space.

As shown, sheet feed system 200 comprises a pick mechanism 205 having a pick arm 207 with pick rollers 209 that is mounted on shaft 211 and a pick arm adjustment mechanism 300 that is mounted on a shaft 211 and pick arm 207. Pick arm adjustment mechanism 300 is more clearly illustrated in FIG. 7A. Shaft 211 is rotatably mounted at one end in an opening 132 provided in mount 130 extending from guide member 118. The other end of shaft 211 extends through opening 134 in right wall extension 114 and is then coupled to a drive source (not shown). As shown, shaft 211 is transverse to the media feed direction indicated by arrow MFD. Pick arm 207 is mounted at a first end 213 to shaft 211 and is generally parallel to media feed direction MFD. Pick rollers 209 are mounted at a second end 215 of the pick arm 207 for contacting a topmost media sheet of media sheets 124 and are driven by the shaft 211 to pick the topmost media sheet of media sheets 124. Shaft 211 receives torque from a drive source (not shown) to provide rotational force to pick rollers 209 to drive the topmost media sheet into media dam 116 and into auxiliary media path 39A.

Figure 7A:
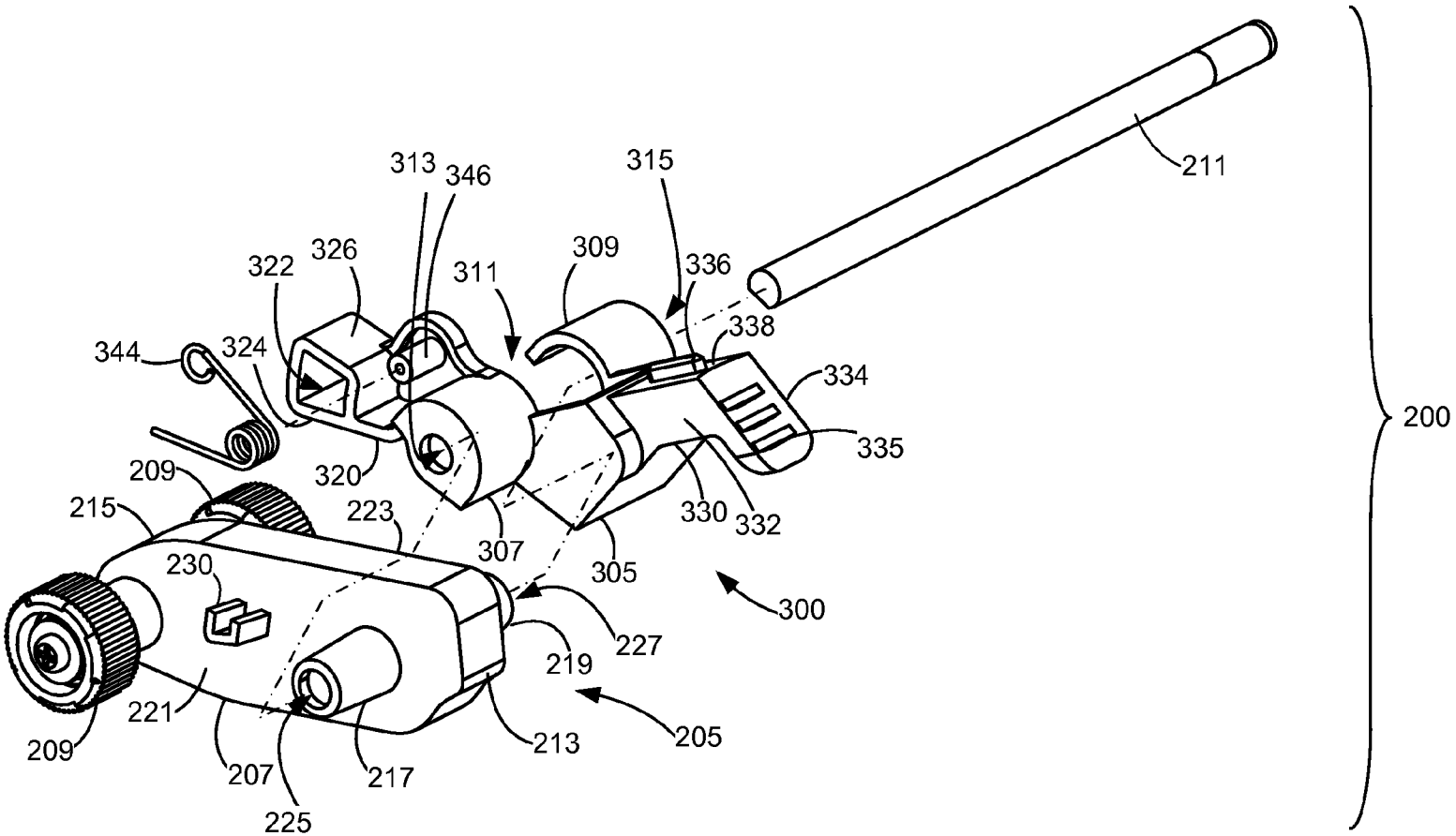
FIG. 7A is an exploded view of the pick arm assembly shown in FIG. 6.

Sheet feed system 200 also includes pick arm adjustment mechanism 300 for adjusting the position of pick arm 107 between a plurality of positions transverse to the media feed direction MFD to accommodate media sheets of different widths. FIG. 7A illustrates an exploded perspective view of the sheet feed system 200 including pick mechanism 205 and pick arm adjustment mechanism 300. Pick arm adjustment mechanism 300 comprises a translating member 305 including a first shell casing 307 and a second shell casing 309 extending from opposite sides of member 305. Translating member 305 is coupled to at least a portion of the first end 213 of pick arm 207. In particular, first and second shell casings 307, 309 form a gap 311 therebetween into which the first end 213 of pick arm 207 is inserted. First and second shell casings 307, 309 partially enclose first and second journals 217, 219, respectively, extending from first and second sides 221, 223, respectively, of pick arm 207. First and second shell casings 307, 309 have openings 313, 315, respectively, and journals 217, 219, have openings 225, 227, respectively, that are aligned with each other for receiving shaft 211 therethrough such that both translating member 305 and pick arm 207 are slidably mounted on shaft 211 and rotatable about a pivot axis defined by shaft 211. Shifting translating member 305 along shaft 211 causes pick mechanism 205 to also translate along shaft 211.

Translating member 305 includes a pivot arm 320 extending from first shell casing 307 towards pick rollers 109 and adjacent the first side 221 of pick arm 207. Alternatively, pivot arm 320 may extend from second shell casing 309 or each of first and second shell casings 307, 309 may have respective pivot arms extending therefrom toward pick rollers 209. Pivot arm 320 may contact and/or engage a lift arm 230 protruding from the first side 221 of pick arm 207 when translating member 305 is actuated so as to lift pick arm 207 away from the topmost media sheets disposed below pick mechanism 205. In an example embodiment, pivot arm 320 may include an aperture 322 that is sized to loosely receive lift arm 230 such that a lower side section 324 of pivot arm 320 may contact and/or engage lift arm 230 depending on a position of the translating member 305, as will be explained in greater detail below. It will be appreciated that pivot arm 320 may lift pick arm 207 by any suitable means such as, for example, by reversing the aperture/lift arm configuration such that pick arm 207 includes an aperture and pivot arm 320 includes a projection.

With further reference to FIG. 7A, translating member 305 further includes a handle 330 having a neck portion 332 and a tab 334 extending from neck portion 332. Handle 330 extends toward a side of the pivot axis defined by shaft 211 opposite the side from which pivot arm 320 extends. Neck portion 332 includes a protrusion 336 projecting from a surface 338 thereof. Disposed above pick mechanism 205 on guide member 118 is a contact plate 340 having a plurality of slots 342*a*-342*d* (see FIG. 6). Slots 342*a*-342*d* define a plurality of predetermined positions at which translating member 305 and pick arm mechanism 205 may be positioned. These predetermined positions correspond to centerlines of different media sheets having different sizes (or widths). Protrusion 336 is dimensioned to fit into each of a plurality of slots 342*a*-342*d* formed on contact plate 340 disposed above pick mechanism 205 to hold pick arm mechanism 205 at the desired media width position. Mount 130 may be provided as part of contact plate 340.

A torsion spring 344 is mounted on a pin 346 extending from pivot arm 320. A first end of torsion spring 344 contacts at least a portion of guide member 118 and a second end of torsion spring 344 contacts an upper side section 326 that forms a portion of aperture 322 on pivot arm 320 so as to bias translating member 305 to rotate in a direction where protrusion 336 abuts contact plate 340 and/or is engaged with one of slots 342*a*-342*d*. Tab 334 is positioned to receive force from a user for rotating translating member 305 about shaft 211 against the rotational biasing force supplied by torsion spring 344 onto translating member 305, and/or translating member 305 along shaft 211. In an example embodiment, tab 334 may include one or more ridges 335 and may be shaped to allow users to easily actuate translating member 305 by direct contact, such as by the use of a thumb, a finger or fingers. In the example embodiment shown in FIG. 7A, handle 330 has a substantially inverted L-shape. It will be appreciated that other shapes or structures may be utilized for handle 330.

Figure 7B:
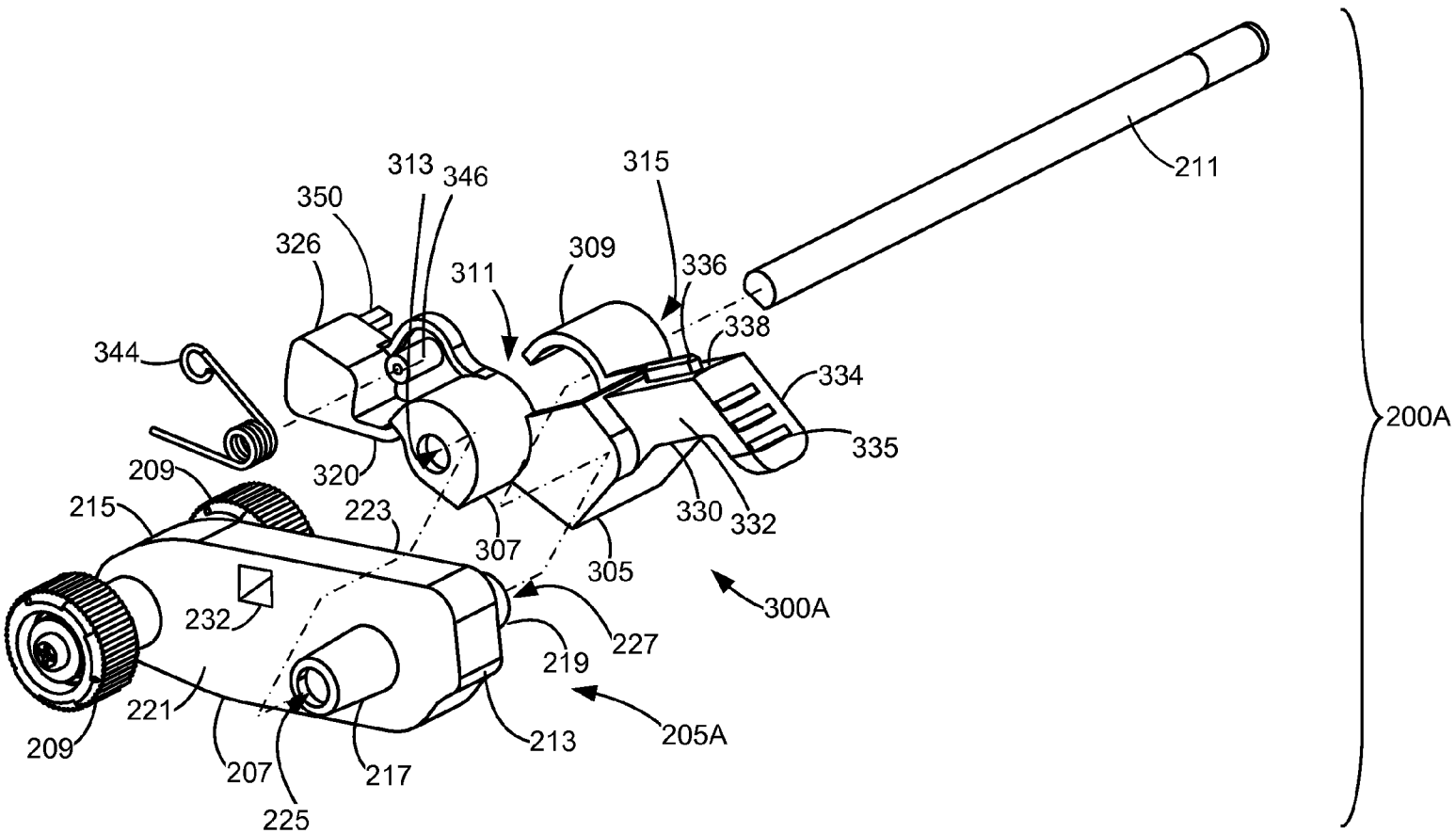
FIG. 7B is an exploded view of a modified pick arm assembly similar to that shown in FIG. 7A.

FIG. 7B illustrates modified sheet feed system 200A. The same components in FIG. 7B will have the same or similar reference numerals as shown in FIG. 7A. In FIG. 7B sheet feed system 200A is substantially identical with sheet feed system 200 except that the lift arm 230 as shown in FIG. 7A has moved to the pivot arm while aperture 322 as shown in FIG. 7A on sheet feed system 200 has moved to the pick arm. In FIG. 7B, a lift arm 350 is now provided on pivot arm 320 while pick arm 207 now contains an aperture 232 sized to loosely receive lift arm 350. Pick mechanism 205A and pick arm adjustment mechanism 300A function in a substantially similar fashion as previously described in relation to pick mechanism 205 and pick arm adjustment mechanism 300 except that lift arm 350 now engages with the walls of aperture 232 to raise pick mechanism 205A from the media stack during translation to one of the slots 342*a*-342*d*.

Figure 8:
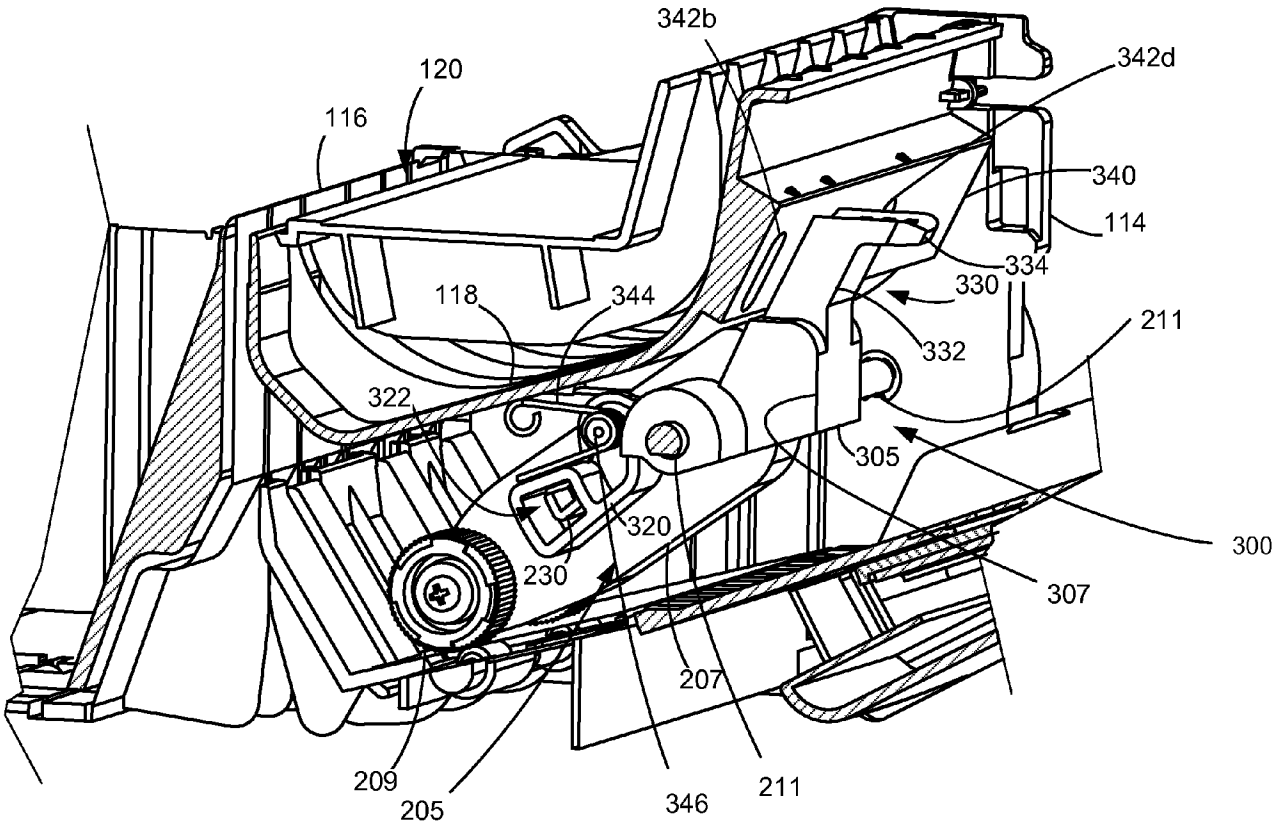
FIG. 8 is a partial sectional perspective view of the sheet feed system in FIG. 6 showing the pick arm in a first predetermined position for one of the supported media widths.
Figure 9:
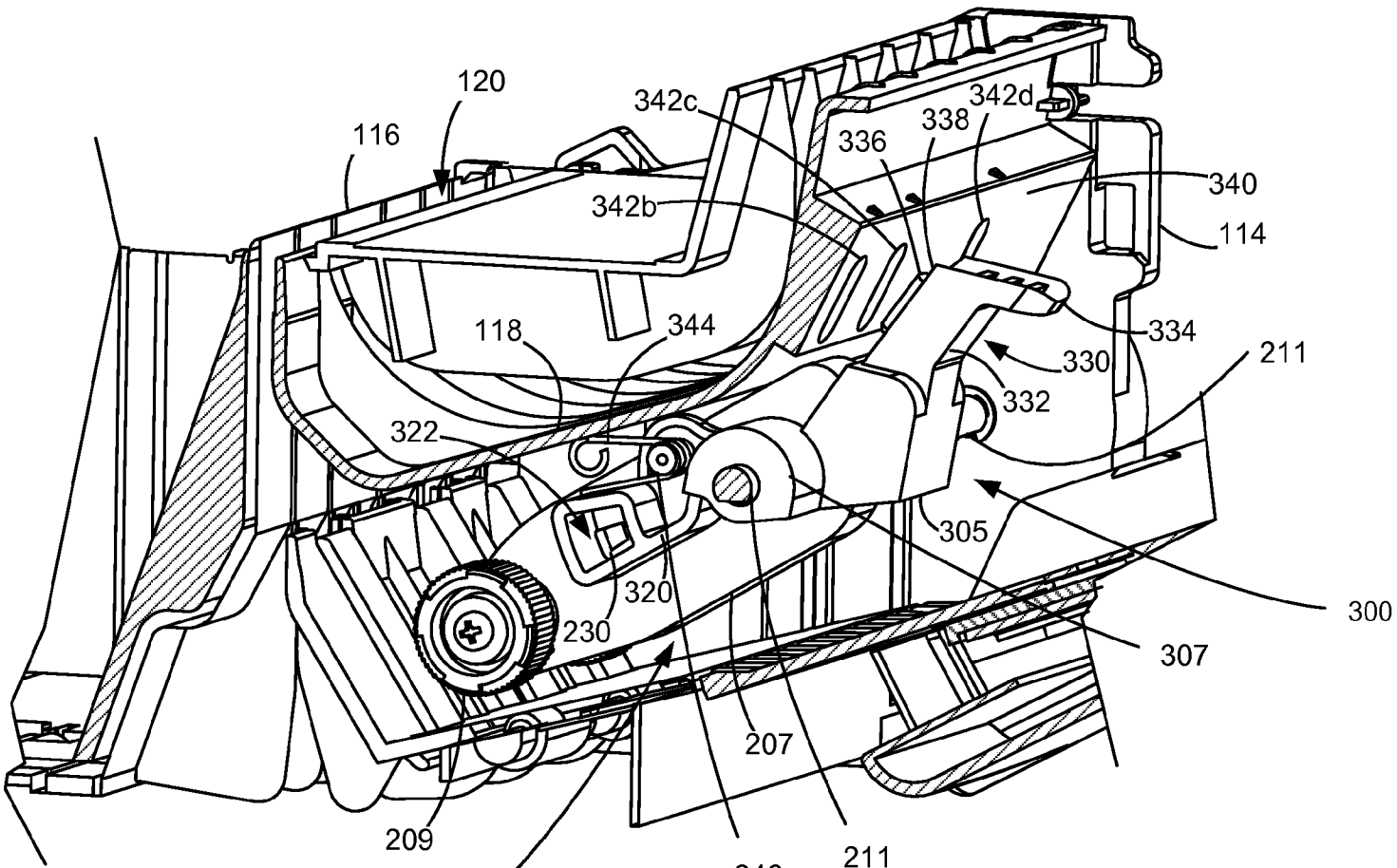
FIG. 9 is a partial sectional perspective view of the sheet feed system in FIG. 6 showing the pick arm in a second position from which the pick arm may be manually translated.

With reference to FIGS. 8 and 9, the operation of the pick arm adjustment mechanism 300 will now be described in more detail. Translating member 305 is rotatable between a first position, as shown in FIG. 8, and a second position, as shown in FIG. 9. In FIG. 8, translating member 305 and pick arm mechanism 205 are located at a predetermined position associated with slot 342*c*, such as when a first media sheet having a centerline corresponding to slot 342*c* is disposed below pick arm mechanism 205. While in the first position, surface 338 of neck portion 332 abuts against contact plate 340 as torsion spring 344 urges translating member 305 to rotate towards the first position by means of biasing engagement with pivot arm 320 and protrusion 336 of neck portion 332 is inserted into slot 342*c*. Meanwhile, pick rollers 209 at the second end 215 of pick arm 207 are displaced downward into contact with the topmost media sheet of a first media type disposed beneath the pick mechanism 205. In this position, lift arm 230 is kept free from any contact with the walls of aperture 322 of pivot arm 320. Such an arrangement prevents pick arm 207 from being influenced by external biasing or rotational forces acting on translating member 305, such as forces supplied by the torsion spring 344, during picking of the topmost media sheet of the first media type by the pick rollers 209. As a consequence of protrusion 336 engaging with slot 342*c*, pick arm 207 is restricted by translating member 305 from moving along shaft 211 such that pick rollers 209 are held substantially evenly positioned about the centerline of the topmost media sheet of the first media type associated with the engaged slot.

When a second media type having a size different from the first media type is to be picked and fed through MPF 16, translating member 305 may be manually rotated to the second position and moved or translated along shaft 211 to another predetermined position associated with one of the other slots corresponding to the centerline of the second media type. In particular, protrusion 336 of neck portion 332 may be disengaged from slot 342*c* by applying a force to tab 334 sufficient enough to overcome the spring force of torsion spring 344 and temporarily rotate translating member 305 about shaft 211 into the second position and dislodging protrusion 336 from slot 342*c*, as shown in FIG. 9. As translating member 305 is rotated to the second position, lower side section 324 of aperture 322 of pivot arm 320 engages lift arm 230 on pick arm 207 thereby lifting pick rollers 209 away from the topmost media sheet of the second media type. Thereafter, translating member 305 and pick arm 207 may be translated along shaft 211 to align protrusion 336 with a selected one of the other slots corresponding to the centerline of the second media type.

When protrusion 336 is aligned with the selected slot on contact plate 340, tab 334 may be released to allow torsion spring 344 to rotate translating member 305 back to the first position and cause protrusion 336 to engage with the selected slot, as illustrated in the arrangement shown in FIG. 8. As translating member 305 rotates back to the first position, lift arm 230 of pick arm 207 is released from engagement with the lower side section 324 of aperture 322 allowing the second end 215 of pick arm 207 to fall free and pick rollers 209 to be displaced downward into contact with the topmost media sheet of the second media type. Pick arm 207 is then restricted by translating member 305 from moving along shaft 211 as a consequence protrusion 336 engaging with the selected slot such that pick rollers 209 are held substantially evenly positioned about the centerline of the second media type. As discussed above, translating member 305 is decoupled from pick arm 207 while in the first position and keeps rotational external forces acting on it from directly acting on pick arm 207 due to lift arm 230 being loosely received and free from any contact with the walls of aperture 322 of pivot arm 320. Thus, pick performance is not impacted.

Figure 10:
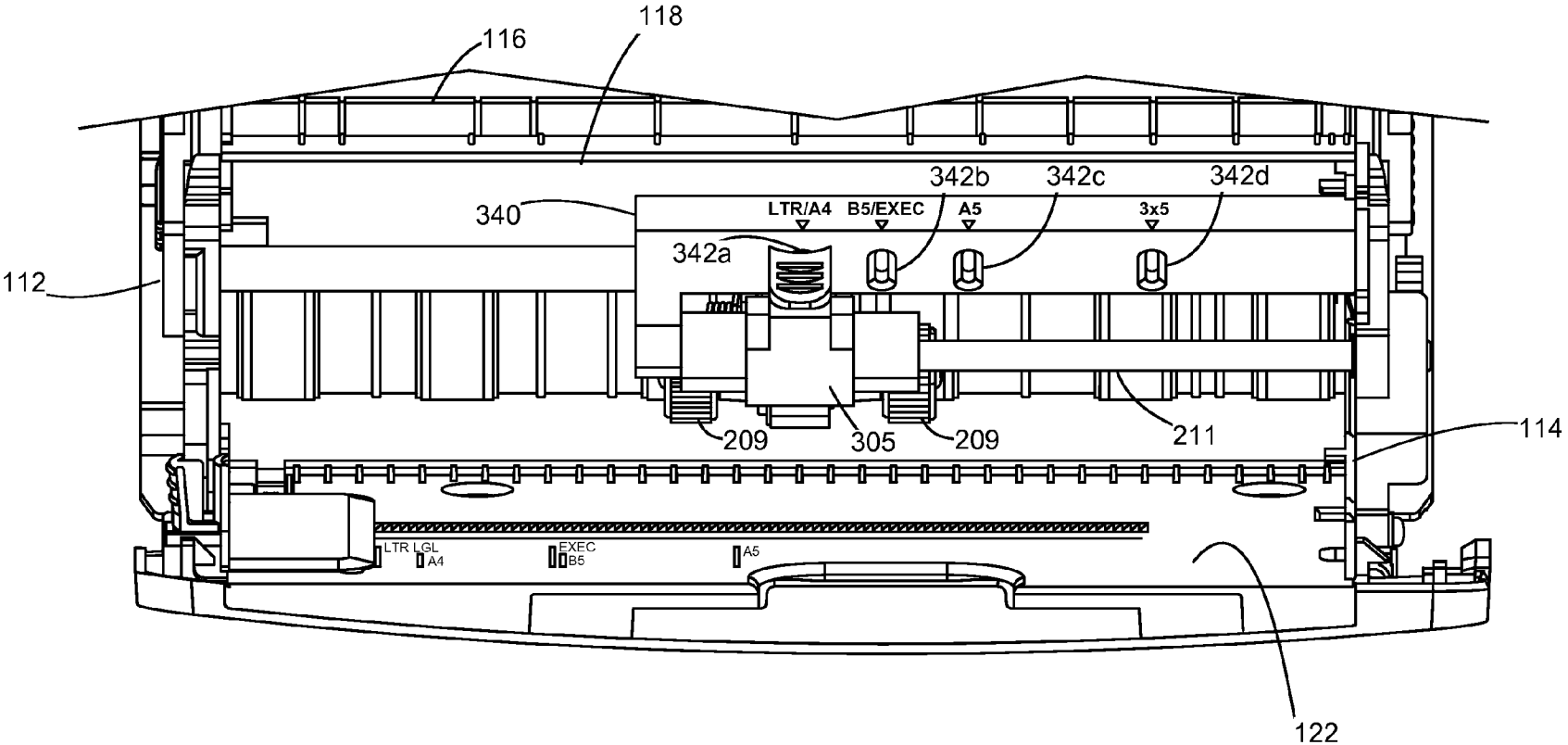
FIG. 10 is a partial front view of the sheet feed system in FIG. 6 showing a contact plate having a plurality of slots corresponding to centerlines of standard media types to which the pick arm assembly may be moved.

FIG. 10 is a front view of the sheet feed system 200 in FIG. 6 showing contact plate 340 with slots 324*a*-342*d* corresponding to centerlines of four standard media types such as Letter/A4, B5/Exec, A5, and 3×5 media. However, it should be understood that contact plate 340 may have any number of slots to allow support for more standard media types, or fewer media types. In addition, other implementations may be utilized such as having a plurality of closely spaced slots or detents to allow for finer manual adjustment of pick arm 207 along shaft 211 to allow support for a variety of non-standard media types. Ultimately, the pick arm adjustment mechanism described herein allows users to manually adjust the position of a pick arm transverse to the media feed direction to substantially balance and center pick forces on a media sheet for a variety of media types.

The descriptions of the details of the example embodiments have been described using the feed system of a multiple-purpose feeder. However, it will be appreciated that the teachings and concepts provided herein are applicable to any paper input source such as automatic document feeders, high capacity input trays or other input options, or standard paper trays without departing from the scope of the present disclosure. The pick arm adjustment mechanism may be mounted within pick arm mechanisms mounted in the imaging apparatus or within housings for media input trays that are add-on options to the imaging apparatus.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. A media picking device in an imaging apparatus comprising:

a shaft for receiving torque from the imaging apparatus;

a pick arm rotatably and slidably mounted at a first end thereof on the shaft, the pick arm rotatable about the shaft between a first and a second position;

at least one pick roller mounted at a second end of the pick arm and, when the pick arm is in the first position, the at least one pick roller contacts a topmost media sheet of a stack of media sheets and is drivable by the shaft to pick the topmost media sheet therefrom; and a translating member coupled with a portion of the first end of the pick arm and slidably and rotatably movable and separately mounted on the shaft from the pick arm, the translating member rotatable about the shaft between the first position and the second position;

wherein the translating member, when rotated to the second position, moves the pick arm and the at least one pick roller from contact with the topmost media sheet and the translating member and pick arm are manually movable along the shaft transverse to a media feed direction between a plurality of predetermined positions corresponding to a plurality of centerlines of media sheets of different widths and, when located at a selected one of the plurality of predetermined positions and being rotated to the first position, the translating member and pick arm are held at the selected one of the plurality of predetermined positions such that the at least one pick roller is returned to contact with a top most media sheet corresponding to the selected one of the plurality of predetermined positions sheet and is substantially evenly positioned about a corresponding centerline of the media sheet corresponding to the selected one of the plurality of predetermined positions.

2. The media picking device of claim 1, wherein the translating member includes a handle having a neck portion and a tab depending from the neck portion, the tab for receiving user-applied force used to rotate the translating member and pick arm to the second position with the handle being used to manually move the translating member and the pick arm along the shaft to the selected one of the plurality of predetermined positions.

3. The media picking device of claim 2, further comprising a contact plate disposed in the imaging apparatus adjacent to the translating member and including a plurality of slots corresponding to the plurality of predetermined positions, the neck portion having a protrusion projecting from a surface thereof and dimensioned to engage each of the plurality of slots of the contact plate so as to hold the pick arm along the shaft at the selected one of the plurality of predetermined positions when the translating member is rotated to the first position.

4. The media picking device of claim 1, wherein the pick arm includes a lift arm protruding therefrom and the translating member includes a pivot arm extending adjacent the pick arm, the pivot arm engaging the lift arm to lift the pick arm and the at least one pick roller away from the topmost media sheet of the stack of media sheets when the translating member is rotated to the second position.

5. The media picking device of claim 4, wherein the lift arm is free from contact with the pivot arm when the translating member and pick arm are rotated to the first position at the selected one of the plurality of predetermined positions.

6. The media picking device of claim 4, further comprising a spring positioned on the pivot arm and between the pivot arm and a contact plate for biasing the pivot arm toward the first position.

7. The media picking device of claim 1, wherein the translating member includes a pivot arm extending adjacent a first side of the pick arm, and one of the translating member and the pivot arm has a lift arm on a side thereof and the other of the translating member and the pivot arm has an aperture sized to loosely receive the lift arm therein and engage with the lift arm to lift the pick arm and the at least one pick roller away from the topmost media sheet of the media sheet stack when the translating member is rotated to the second position.

8. The media picking device of claim 7, wherein the lift arm is not engaged with the aperture when the translating member is at the first position at the selected one of the plurality of predetermined positions.

9. The media picking device of claim 7, further comprising a spring positioned on the pivot arm and between the pivot arm and a contact plate for biasing the pivot arm toward the first position.

10. A media feed system in an imaging apparatus, the media feed system comprising:

a shaft for receiving torque;

a pick mechanism having a pick arm and at least one pick roller, the pick arm rotatably and slidably mounted at a first end thereof on a shaft and rotatable about the shaft between a first position and a second position, the at least one pick roller mounted to a second end of the pick arm for contacting a topmost media sheet of a stack of media sheets when in the first position and drivable by the shaft to pick the topmost media sheet of the stack of media sheets; and a pick arm translation mechanism manually movable between a plurality of predetermined positions along the shaft, the pick arm translation mechanism comprising:

a translating member rotatably and slidably mounted on the shaft and coupled to at least a portion of the first end of the pick arm such that, when the pick arm is rotated from the first position to the second position, the at least one pick roller is lifted off of the topmost media sheet allowing manual translation of the translating member and pick mechanism transverse to a media feed direction between the plurality of predetermined positions associated with a plurality of different sized media sheets; and a biasing member for biasing the translating member in the first position.

11. The system of claim 10, wherein each of the plurality of predetermined positions of the translating member corresponds to a centerline of a corresponding one of the plurality of different sized media sheets.

12. The system of claim 10, wherein the translating member is held at a selected one of the plurality of predetermined positions when rotated to the first position.

13. The system of claim 12, wherein the translating member includes a handle having a neck portion and a tab depending from the neck portion, the tab for receiving a user-applied force to rotate the translating member between the first and second positions with the handle being used to manually move the translating member and the pick arm along the shaft to the selected one of the plurality of predetermined positions.

14. The system of claim 13, further comprising a contact plate disposed in the imaging apparatus adjacent the neck portion of the handle and including a plurality of slots corresponding to the plurality of predetermined positions, the neck portion having a protrusion projecting from a surface thereof and dimensioned to engage with each of the plurality of slots of the contact plate so as to hold the pick arm when the translating member is positioned at the selected one of the plurality of predetermined positions and rotated to the first position.

15. The system of claim 14, wherein application of the user-applied force on the tab when the translating member is in the first position disengages the protrusion when engaged in one of the plurality of slots on the contact plate.

16. The system of claim 12, wherein the translating member includes a pivot arm extending adjacent the pick arm, wherein the pivot arm and the pick arm are coupled together during rotation of the translating member between the first and second positions and, while in the first position at the selected one of the plurality of predetermined positions, the pivot arm is decoupled from the pick arm.

17. The system of claim 16, wherein the pick arm includes a lift arm protruding therefrom, the pivot arm engaging with the lift arm to lift the pick arm and the at least one pick roller away from the topmost sheet of the media sheet stack when the translating member is rotated to the second position.

18. The system of claim 17, wherein the lift arm is free from contact with the pivot arm when the translating member is rotated to the first position at the selected one of the plurality of predetermined positions.

19. The system of claim 16, wherein the biasing member comprises a torsion spring mounted to a pin extending from the pivot arm, a first end of the torsion spring contacting at least a portion of the imaging apparatus and a second end of the torsion spring contacting the pivot arm biasing the translating member to rotate towards the first position.

20. The system of claim 19, wherein the pivot arm has a lower side section for engaging the lift arm when the translating member is rotated to the second position and an upper side section for being continuously engaged by the second end of the torsion spring so as to bias the translating member to rotate to the first position.

21. A media feed system in an imaging apparatus, the media feed system comprising:

a shaft for receiving torque, the shaft mounted on a housing and disposed over a media tray having a stack of media sheets, the shaft positioned transverse to a media feed direction;

a pick mechanism having a pick arm, the pick arm rotatably and slidably mounted at a first end thereof on the shaft, and one or more pick rollers mounted to a second end of the pick arm, the pick arm rotatable between a first position and a second position and when the pick arm is in the first position the one or more pick rollers contact a topmost media sheet of the stack of media sheets and are drivable by the shaft to pick the topmost media sheet from the media stack; and a pick arm translation member rotatably and slidably mounted on the shaft and coupled with at least a portion of the first end of the pick arm such that translation of the pick arm translation member along the shaft moves the pick arm therewith, the pick arm translation member being separately mounted on the shaft from the pick arm;

the pick arm translation member being manually movable along the shaft between a plurality of predetermined positions associated with different media sheet sizes, each of the plurality of predetermined positions corresponding to a centerline of a corresponding one of the different media sheet sizes such that the pick arm and the one or more pick rollers remain substantially evenly positioned about a centerline of a media sheet corresponding to a selected predetermined position when the media sheet is disposed on the media tray.

22. The media feed system of claim 21, wherein the shaft defines a pivot axis of the pick arm translation member, the pick arm translation member including a handle on a first side of the pivot axis and a pivot arm on a second side of the pivot axis opposite the first side, wherein the handle, upon receipt of a user-applied force, causes the pivot arm to couple with and lift the pick arm away from the topmost media sheet and rotate the pick arm translation member and the pick arm to the second position where the pick arm translation member and pick arm are translatable to a selected one of the plurality of predetermined positions and further wherein, when the pick arm and pick arm translation member are translated to the selected one of the plurality of predetermined positions and rotated to the first position, the pick arm translation member is decoupled from the pick arm.

23. A media picking device in an imaging apparatus comprising:

a shaft for receiving torque from the imaging apparatus;

a pick arm rotatably and slidably mounted at a first end thereof on the shaft, the pick arm rotatable about the shaft between a first and a second position;

at least one pick roller mounted at a second end of the pick arm and, when the pick arm is in the first position, the at least one pick roller contacts a topmost media sheet of a stack of media sheets and is drivable by the shaft to pick the topmost media sheet therefrom; and a translating member coupled with a portion of the first end of the pick arm and slidably and rotatably movable and mounted on the shaft, the translating member rotatable about the shaft between the first position and the second position;

wherein the translating member, when rotated to the second position, moves the pick arm and the at least one pick roller from contact with the topmost media sheet and the translating member and pick arm are manually movable along the shaft transverse to a media feed direction between a plurality of predetermined positions corresponding to a plurality of centerlines of media sheets of different widths and, when located at a selected one of the plurality of predetermined positions and being rotated to the first position, the translating member and pick arm are held at the selected one of the plurality of predetermined positions such that the at least one pick roller is returned to contact with a top most media sheet corresponding to the selected one of the plurality of predetermined positions and is substantially evenly positioned about a corresponding centerline of the media sheet corresponding to the selected one of the plurality of predetermined positions; and wherein the translating member includes a handle having a neck portion and a tab depending from the neck portion, the tab for receiving user-applied force used to rotate the translating member and pick arm to the second position with the handle being used to manually move the translating member and the pick arm along the shaft to the selected one of the plurality of predetermined positions.

24. The media picking device of claim 23, further comprising a contact plate disposed in the imaging apparatus adjacent to the translating member and including a plurality of slots corresponding to the plurality of predetermined positions, the neck portion having a protrusion projecting from a surface thereof and dimensioned to engage each of the plurality of slots of the contact plate so as to hold the pick arm along the shaft at the selected one of the plurality of predetermined positions when the translating member is rotated to the first position.

25. A media picking device in an imaging apparatus comprising:

a shaft for receiving torque from the imaging apparatus;

a pick arm rotatably and slidably mounted at a first end thereof on the shaft, the pick arm rotatable about the shaft between a first and a second position;

at least one pick roller mounted at a second end of the pick arm and, when the pick arm is in the first position, the at least one pick roller contacts a topmost media sheet of a stack of media sheets and is drivable by the shaft to pick the topmost media sheet therefrom; and a translating member coupled with a portion of the first end of the pick arm and slidably and rotatably movable and mounted on the shaft, the translating member rotatable about the shaft between the first position and the second position;

wherein the translating member, when rotated to the second position, moves the pick arm and the at least one pick roller from contact with the topmost media sheet and the translating member and pick arm are manually movable along the shaft transverse to a media feed direction between a plurality of predetermined positions corresponding to a plurality of centerlines of media sheets of different widths and, when located at a selected one of the plurality of predetermined positions and being rotated to the first position, the translating member and pick arm are held at the selected one of the plurality of predetermined positions such that the at least one pick roller is returned to contact with a top most media sheet corresponding to the selected one of the plurality of predetermined positions and is substantially evenly positioned about a corresponding centerline of the media sheet corresponding to the selected one of the plurality of predetermined positions; and wherein the pick arm includes a lift arm protruding therefrom and the translating member includes a pivot arm extending adjacent the pick arm, the pivot arm engaging the lift arm to lift the pick arm and the at least one pick roller away from the topmost media sheet of the stack of media sheets when the translating member is rotated to the second position.

26. The media picking device of claim 25, wherein the lift arm is free from contact with the pivot arm when the translating member and pick arm are rotated to the first position at the selected one of the plurality of predetermined positions.

27. The media picking device of claim 26, further comprising a spring positioned on the pivot arm and between the pivot arm and a contact plate for biasing the pivot arm toward the first position.

28. A media picking device in an imaging apparatus comprising:

a shaft for receiving torque from the imaging apparatus;

a pick arm rotatably and slidably mounted at a first end thereof on the shaft, the pick arm rotatable about the shaft between a first and a second position;

at least one pick roller mounted at a second end of the pick arm and, when the pick arm is in the first position, the at least one pick roller contacts a topmost media sheet of a stack of media sheets and is drivable by the shaft to pick the topmost media sheet therefrom; and a translating member coupled with a portion of the first end of the pick arm and slidably and rotatably movable and mounted on the shaft, the translating member rotatable about the shaft between the first position and the second position;

wherein the translating member, when rotated to the second position, moves the pick arm and the at least one pick roller from contact with the topmost media sheet and the translating member and pick arm are manually movable along the shaft transverse to a media feed direction between a plurality of predetermined positions corresponding to a plurality of centerlines of media sheets of different widths and, when located at a selected one of the plurality of predetermined positions and being rotated to the first position, the translating member and pick arm are held at the selected one of the plurality of predetermined positions such that the at least one pick roller is returned to contact with a top most media sheet corresponding to the selected one of the plurality of predetermined positions and is substantially evenly positioned about a corresponding centerline of the media sheet corresponding to the selected one of the plurality of predetermined positions; and wherein the translating member includes a pivot arm extending adjacent a first side of the pick arm, and one of the translating member and the pivot arm has a lift arm on a side thereof and the other of the translating member and the pivot arm has an aperture sized to loosely receive the lift arm therein and engage with the lift arm to lift the pick arm and the at least one pick roller away from the topmost media sheet of the media sheet stack when the translating member is rotated to the second position.

29. The media picking device of claim 28, wherein the lift arm is not engaged with the aperture when the translating member is at the first position at the selected one of the plurality of predetermined positions.

30. The media picking device of claim 28, further comprising a spring positioned on the pivot arm and between the pivot arm and a contact plate for biasing the pivot arm toward the first position.

* * * * *